US007090534B2

(12) United States Patent
Wu et al.

(10) Patent No.: US 7,090,534 B2
(45) Date of Patent: Aug. 15, 2006

(54) CABLE ASSEMBLY WITH ALIGNMENT DEVICE

(75) Inventors: Jerry Wu, Tu-Chen (TW); Hongbo Zhang, Kunsan (CN); Peter Kuo, Tu-Chen (TW)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 0 days.

(21) Appl. No.: 11/173,746

(22) Filed: Jun. 30, 2005

(65) Prior Publication Data

US 2006/0121783 A1 Jun. 8, 2006

(30) Foreign Application Priority Data

Dec. 4, 2004 (CN) ..... 2004 2 0054135 U

(51) Int. Cl.
*H01R 13/648* (2006.01)

(52) U.S. Cl. ..... 439/607; 439/701

(58) Field of Classification Search ..... 439/607, 439/608, 609, 660, 701, 939

See application file for complete search history.

(56) References Cited

U.S. PATENT DOCUMENTS

| | | | | |
|---|---|---|---|---|
| 6,659,801 | B1 * | 12/2003 | Nishio et al. | 439/610 |
| 6,685,508 | B1 * | 2/2004 | Zhu et al. | 439/607 |
| 6,905,366 | B1 * | 6/2005 | Yang | 439/607 |
| 6,986,681 | B1 * | 1/2006 | Tsai | 439/607 |
| 2003/0129875 | A1 | 7/2003 | Ho | |
| 2005/0245132 | A1 * | 11/2005 | Huang et al. | 439/607 |

* cited by examiner

*Primary Examiner*—Hien Vu
(74) *Attorney, Agent, or Firm*—Wei Te Chung

(57) ABSTRACT

A cable assembly (100) includes an insulative housing (1) defining a plurality of passages (13) therethrough, an alignment device (3) having a spacer (300) sealing up rear openings of the passages and defining a number of through holes (302) in alignment with the passages, a plurality of contacts (2) received in corresponding passages, and a cable (5) having a number of conductors (50) electrically connected to the contacts. Each contact 9 includes a mating portion (20) and an opposite tail portion (22) passing through the through hole and arranged by the alignment device. The alignment device defines a plurality of channels (304) communicating with corresponding through holes for positioning the conductors of the cable and a positioning flange for preventing the conductors from escaping from the channels.

12 Claims, 9 Drawing Sheets

CABLE ASSEMBLY WITH ALIGNMENT DEVICE

BACKGROUND OF THE INVENTION

1. Field of the Invention

The present invention generally relates to a cable assembly, and more particularly to a High-Definition Multimedia Interface (HDMI) cable assembly.

2. Description of Related Art

Developed by Sony, Hitachi, Thomson (RCA), Philips, Matsushita (Panasonic), Toshiba and Silicon Image, the High-Definition Multimedia Interface (HDMI) has emerged as the connection standard for HDTV and the consumer electronics market. HDMI is the first and only digital interface to combine uncompressed high-definition video, multi-channel audio and intelligent format and command data in a single digital interface.

According to the connection standard of HDMI, an HDMI cable assembly generally comprises an insulative housing having a plurality of passages, a plurality of contacts disposed in the housing, a shielding shell surrounding the housing, a cable having a plurality of conductors terminated to the contacts and an insulated protecting cover molded over joint portions of the cable and the contacts. In addition, a spacer is provided to seal up rear openings of the passages during molding of the protecting cover. Generally, the spacer defines a plurality of though holes permitting tail portions of the contacts passing through to solder with the conductors of the cable. For achieving desired soldering effect, the tail portions and the conductors are supported by a rearwardly extending supporting plate. However, as conductors are respectively laid on the corresponding tail portions of the contacts in a moveable way, an additional aiding equipment is required to align and position the conductors during soldering process for ensuring soldering accuracy.

Hence, a cable assembly with improved alignment device is highly desired to overcome the disadvantages of the related art.

SUMMARY OF THE INVENTION

Accordingly, an object of the present invention is to provide a cable assembly having an alignment device with improved structure for firmly positioning conductors of a cable before soldering the cable to contacts.

In order to achieve the object set forth, a cable assembly in accordance with the present invention comprises an insulative housing defining a mating interface, a connecting interface and a plurality of passages extending between the mating interface and the connecting interface, an alignment device assembled to the housing and having a spacer sealing rear openings of the passages in the connection interface of the housing, a plurality of contacts extending from the connecting interface toward the mating interface, and a cable having a plurality of conductors electrically connected to the terminals. The spacer defines a plurality of through holes respectively in alignment with the passages. Each contact comprising a mating portion received in the corresponding passage and a tail portion adjacent to the connecting interface passing through corresponding through holes and arranged by the alignment device. The alignment device comprises a plurality of channels in communication with the corresponding through holes for receiving the conductors of the cable and a stopping flange to prevent the conductors escaping from corresponding channels.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
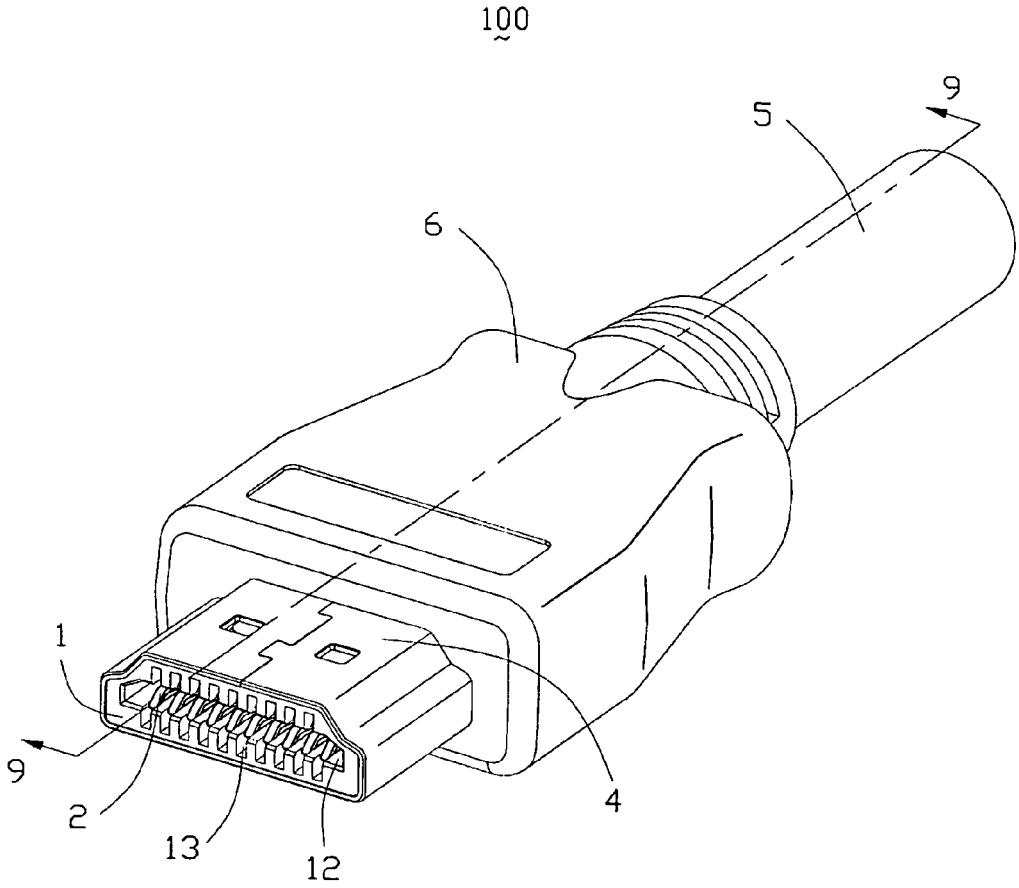
FIG. 1 is an assembled, perspective view of a cable assembly in accordance with the present invention.
Figure 2:
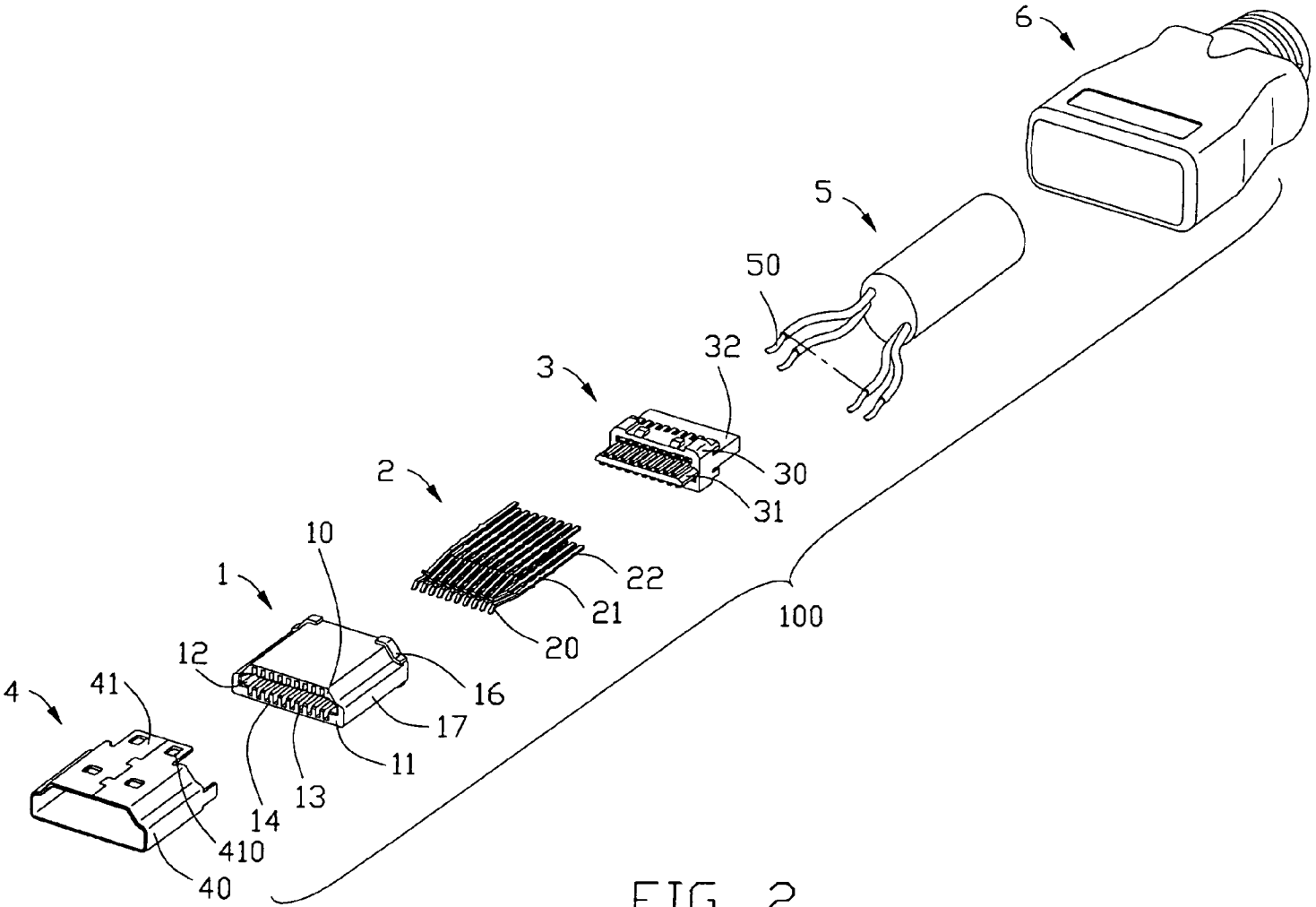
FIG. 2 is an exploded, perspective view of FIG. 1.
Figure 3:
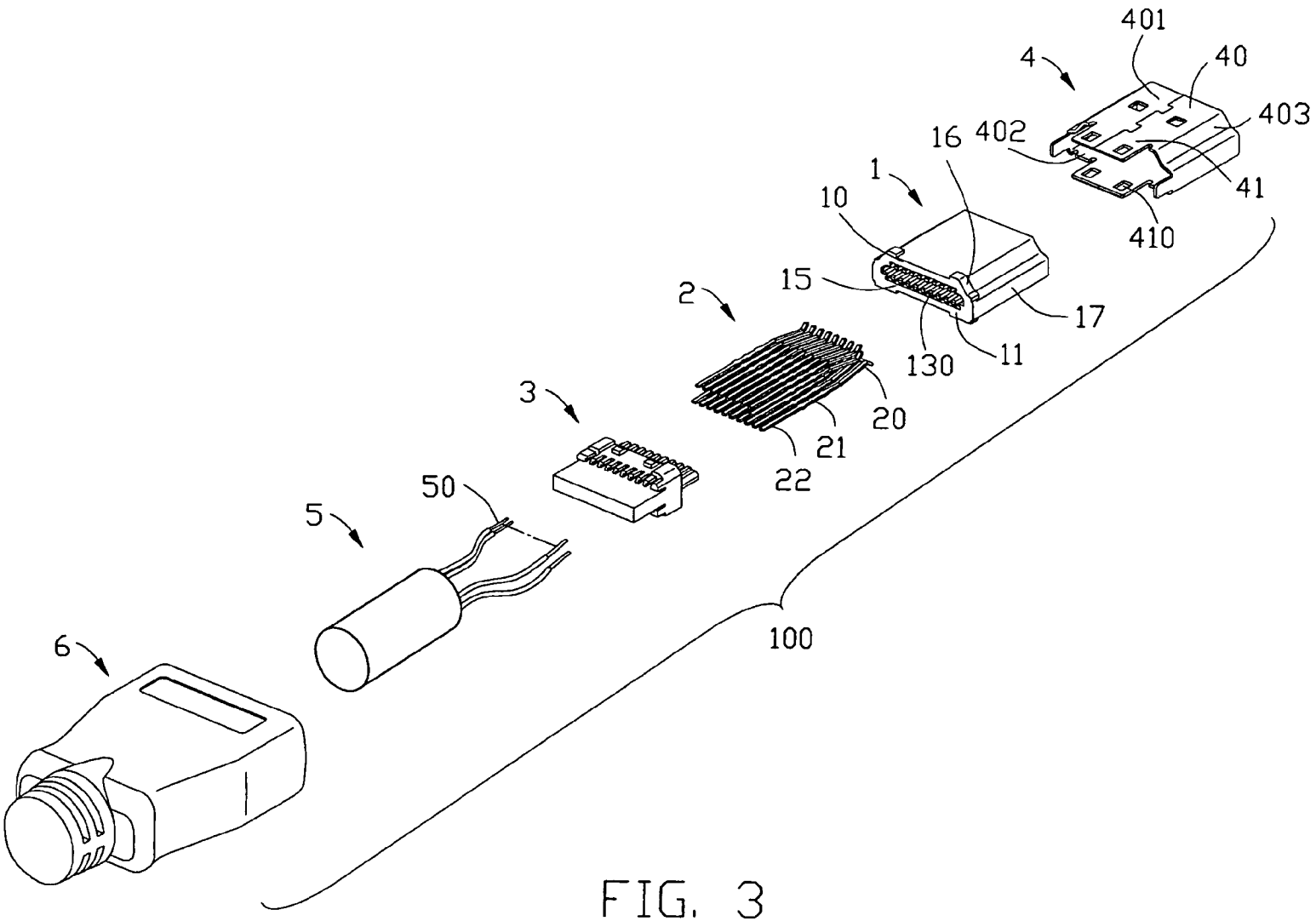
FIG. 3 is a view similar to FIG. 2, but viewed from another aspect.

Referring to FIGS. 1–3, a cable assembly 100 in accordance with the present invention comprises an insulative housing 1, a plurality of contacts 2 disposed in the housing 1, an alignment device 3 assembled to the housing 1, a cable 5 having a plurality of conductors 50 terminated to corresponding contacts 2, a shielding shell 4 surrounding the housing 1 and a protecting cover 6 enclosing joint portions of the conductors 50 and the contacts 2.

The housing 1 defines a mating interface 14 and a connecting interface 15 opposite to the mating interface 14. The housing 1 is formed of an upper wall 10, a lower wall 11 extending parallel to the upper wall 10 and a pair of side walls 17 extending between the upper and lower walls 10, 11. The upper, lower and side walls 10, 11, 17 together define a receiving cavity 12. A plurality of passages 13 are defined in inner surface of the upper wall 10 and lower wall 11 through the connecting interface 15 of the housing 1 and in communication with the receiving cavity 12. Thus, the connecting interface 15 has a plurality of openings 130 corresponding to the passages 13. Besides, each of the upper wall 10 and the lower wall 11 comprises a pair of blocks 16 protruding outwardly from rear outer surfaces thereof, respectively.

Each contact 2 comprises a mating portion 20, a terminating portion 22 opposite to the mating portion 20 and a retaining portion 21 between the mating portion 20 and the terminating portion 22. The retaining portion 21 has a plurality of barbs (not labeled) on opposite sides thereof for interferencely securing to the housing 1. The mating portions 20 are respectively received in corresponding passages 13 and partially exposed to the receiving cavity 12. The terminating portions 22 extend beyond the connecting interface 15.

Figure 4:
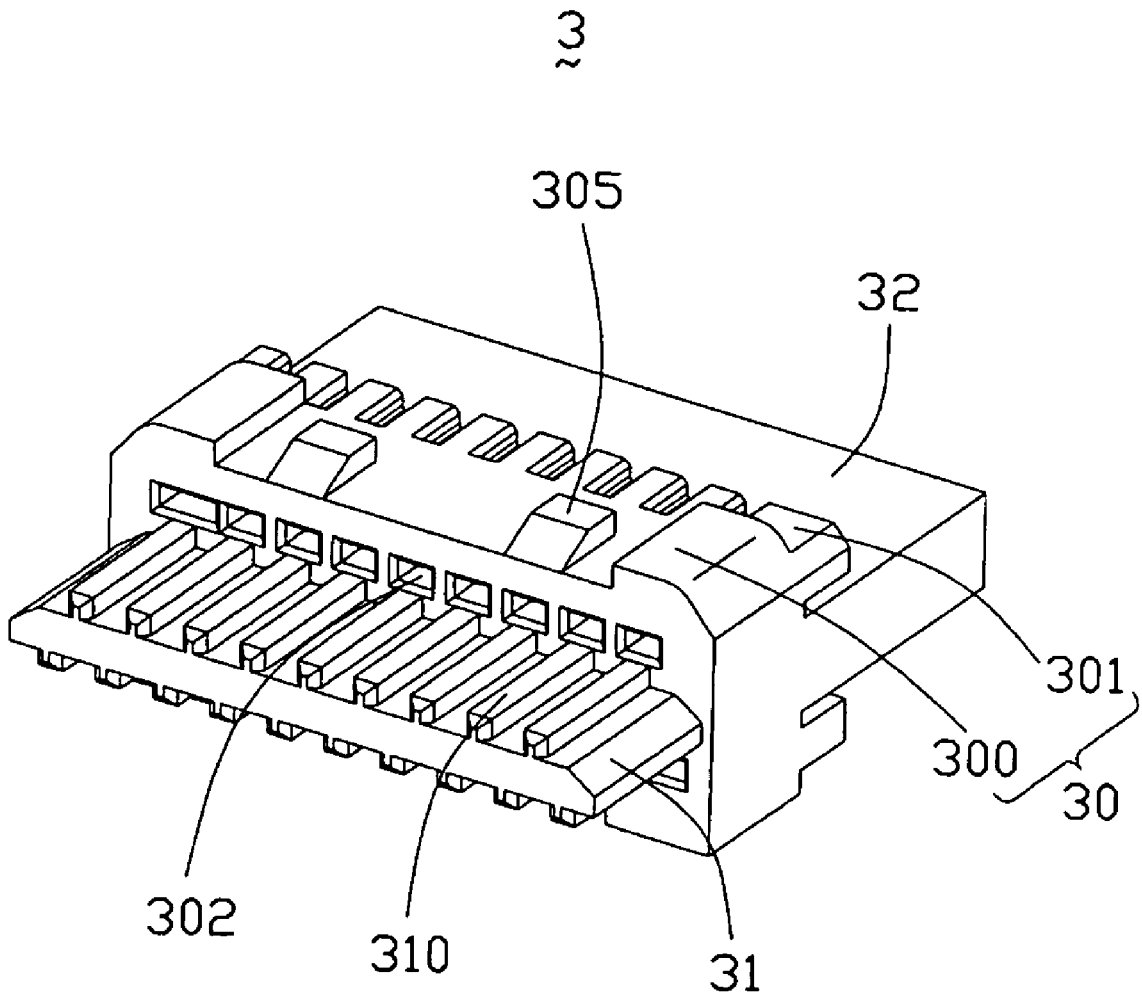
FIG. 4 is an enlarged view of an alignment device of FIG. 2.
Figure 5:
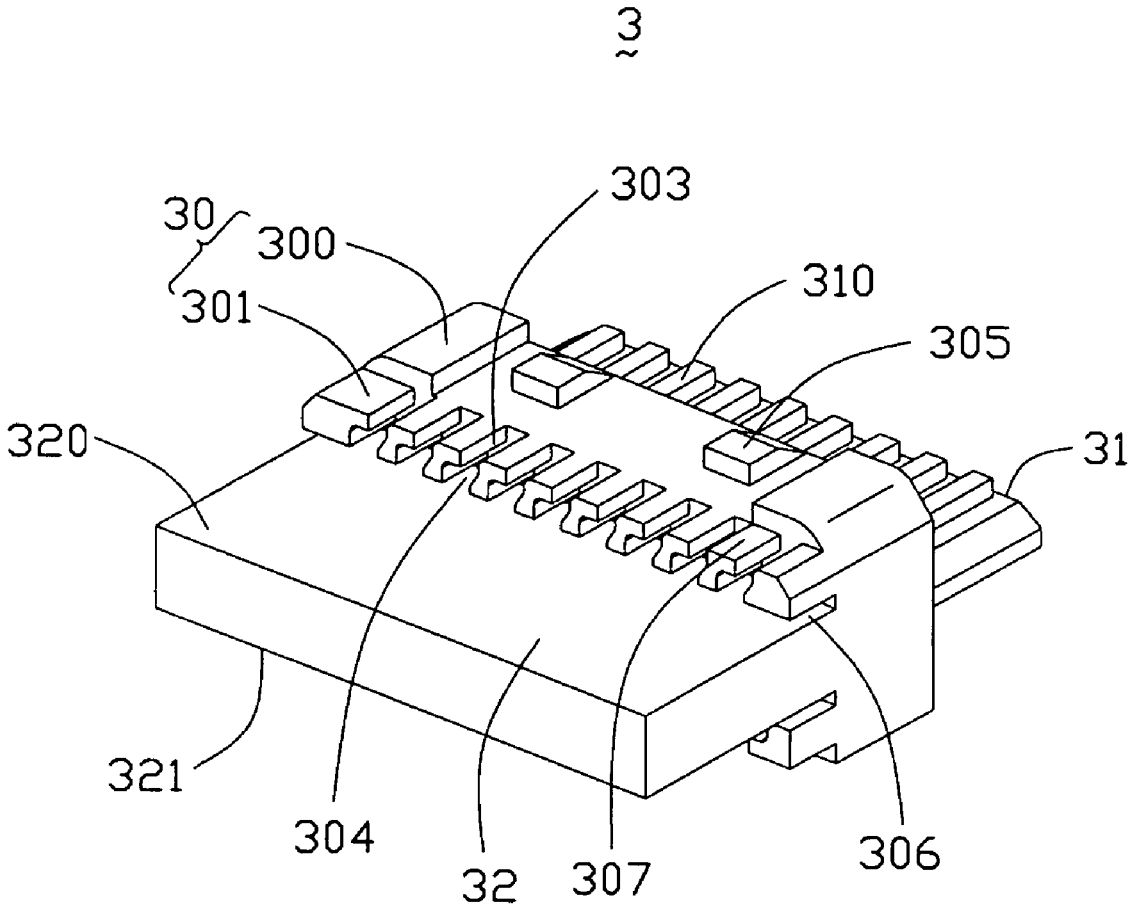
FIG. 5 is a view similar to FIG. 4, but viewed from another aspect.
Figure 6:
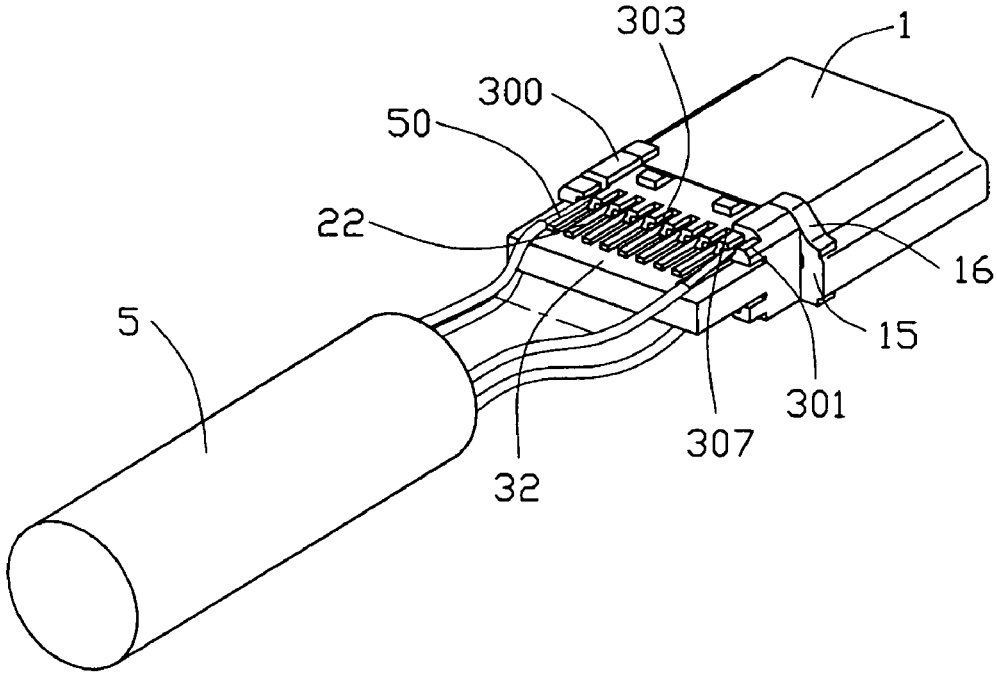
FIG. 6 is a partially assembled view of FIG. 3.
Figure 7:
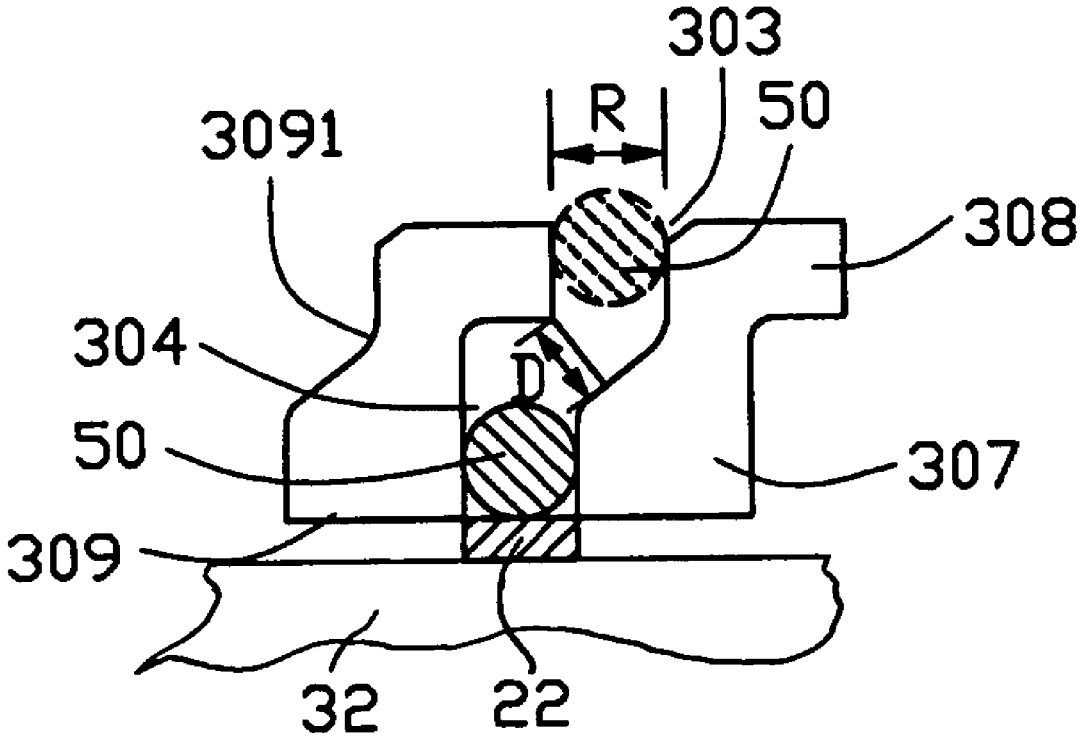
FIG. 7 is a view illustrating different positions of a conductor of FIG. 3 relative to a channel of the alignment device of FIG. 3.

Particularly referring to FIGS. 4 and 5, the alignment device 3 assembled to the housing 1, comprises a base portion 30 defining a plurality of through holes 302 permitting terminating portions 22 of the contacts 2 to pass though, a forward plate 31 extending forwardly from the base portion 30 into the receiving cavity 12 of the housing 1 and a rear supporting plate 32 with the terminating portions 22 laid on opposite surfaces thereof. The base portion 30 is formed of a spacer 300 extending beyond upper and lower surfaces of the forward and supporting plates 31, 32 and a pair of stopping plates 301 extending from the spacer 300 respectively suspending on upper and lower sides of the supporting plate 32. A pair of gaps 306 is thus defined between the supporting plate 32 and the stopping plates 301. The spacer 300 has a pair of wedgy-shaped projections 305 on upper and lower surfaces thereof for latching with the shielding shell 4. Each stopping plate 301 has a plurality of portions cut away to form a plurality of cutouts 303, a plurality of posts 307 having reversed L-shaped cross section, and a plurality of channels 304 defined between the posts 307 and communicating with corresponding cutouts 303. The cutouts 303 respectively offset from corresponding channels 304 in a vertical direction. The channels 304 are respectively in communication with corresponding through holes 302. Particularly referring to FIG. 7, each post 307 has a reversed L-shaped cross section, composed of a lateral portion 308 and a vertical portion 309. The vertical portion 309 comprises a first portion (not labeled) adjacent the supporting plate 32 and a second portion (not labeled) connected with the lateral portion 308. The first portion has a dimension in lateral direction larger than that of the second portion, therefore, there forms an arcuate transitional portion 3091 smoothly connecting the first and second portions. Moreover, every two neighboring posts 307 define the narrowest distance D therebetween. The forward plate 31 comprises a plurality of bars 310 on opposite sides thereof respectively in alignment with corresponding passages 13 of the housing 1. Therefore, after the alignment device 3 and the contacts 2 are assembled to the housing 1, the bars 310 of the forward plate 31 respectively support corresponding retaining portions 21 of the contacts 2 as well as substantially fill up the receiving cavity 12 of the housing 1. Besides, the stopping plates 301 and the supporting plate 32 can be integrally formed without defining the gaps 306 therebetween.

The conductors 50 of the cable 5 are respectively pressed into corresponding channels 304 from the cutouts 303 and laid on corresponding terminating portions 22 of the contacts 2. It should be noted that the diameter (labeled as R) of each conductors 50 is larger than the narrowest distance D between two posts 307 for preventing the conductors 50 escaping from the channels 304, and the lateral portions 308 of the posts 307 together form a positioning flange (not labeled) limiting upward/downward movement of the conductors 50. In this way, as the conductors 50 are well positioned in the channels 304, the terminating portions 22 and the conductors 50 are conveniently soldered to each other with high accuracy. In addition, it is considerable to put solder slugs into each of the channels 304, when the solder slugs are heated, they are melted to solder the conductors 50 and the terminating portions 22 of the contacts 2 together.

Figure 8:
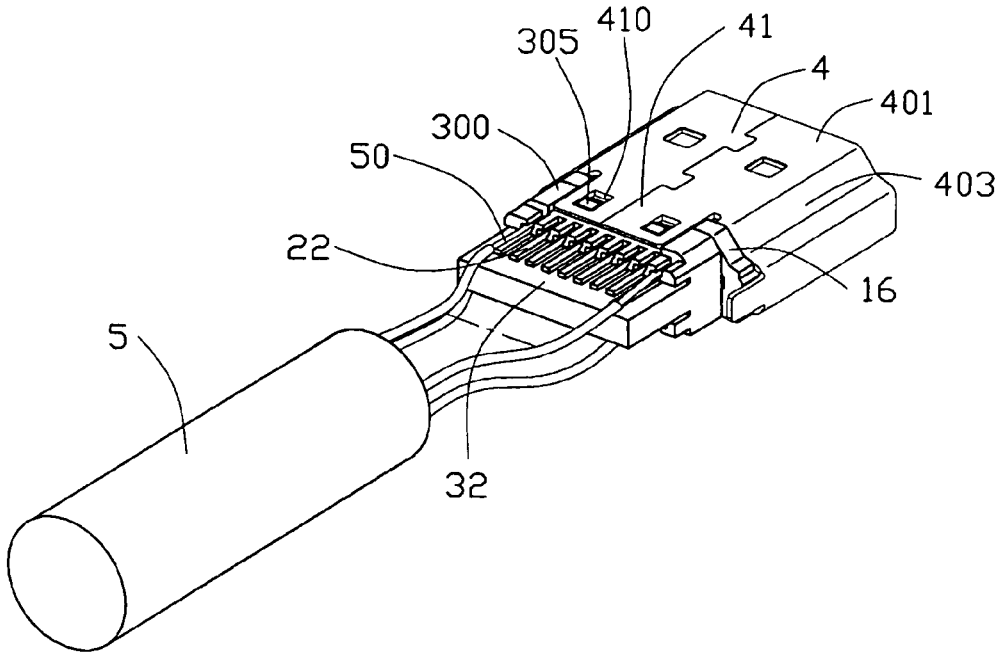
FIG. 8 is a partially assembled view of FIG. 3 before a protecting cover of FIG. 3 assembled.

Referring to FIGS. 3 and 8, the shielding shell 4 is formed by a single metal plate and assembled to the housing 1 and the alignment device 3. The shielding shell 4 comprises a main portion 40 and a pair of engaging portions 41 rearwardly extending to engage with the alignment device 3. Each engaging portion 41 defines a pair of apertures 410 spaced arranged thereon for latching with the corresponding projections 305 of the alignment device 3. The main portion 40 comprises a top wall 401, a bottom wall 402 and a pair of side walls 403 extending between the top wall 401 and the bottom wall 402. The main portion 40 sheathes over the housing 1 with a rear edge thereof in contact with the rear blocks 16 of the housing 1. Therefore, the shielding shell 4, the alignment device 3 and the housing 1 are assembled together as a whole unit.

Figure 9:
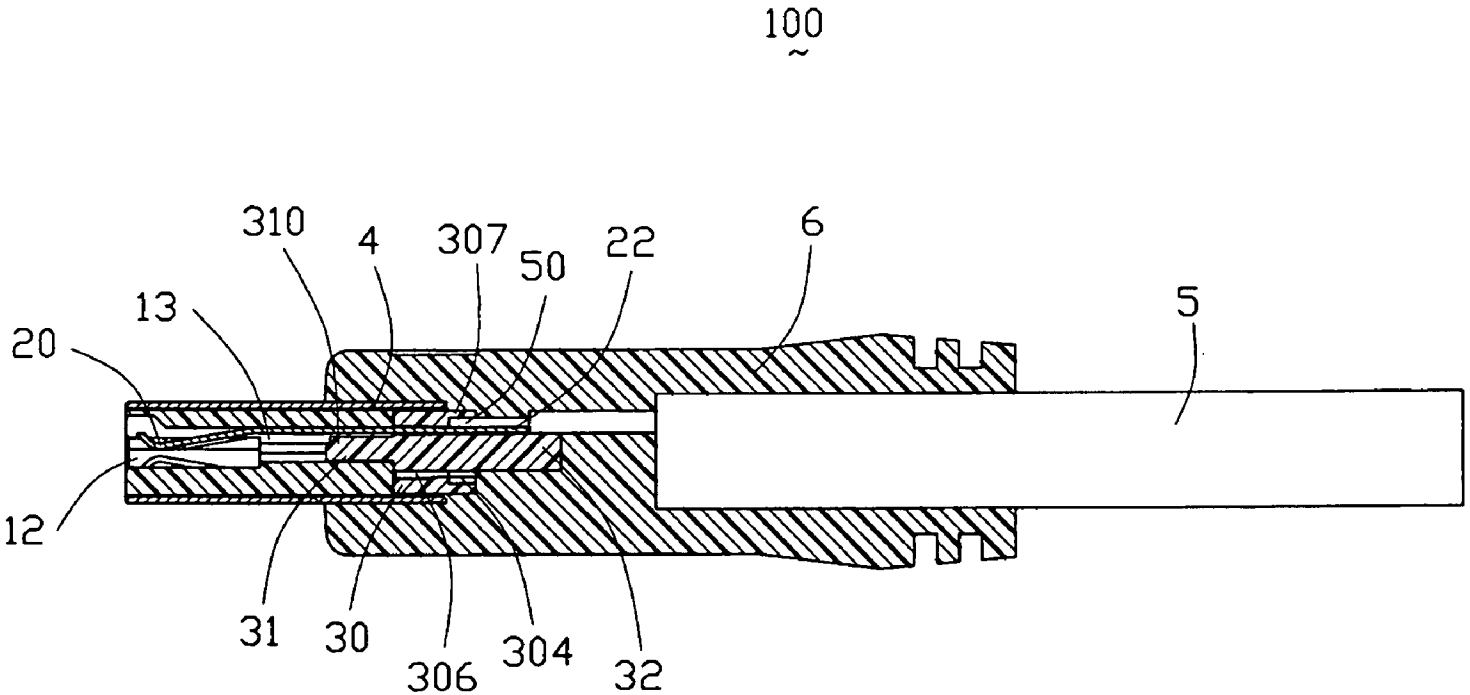
FIG. 9 is a cross-sectional view of FIG. 1 taken along line 9—9.

Referring to FIG. 1 and FIG. 9, the protecting cover 6 is molded over rear portions of the housing 1, the shielding shell 4 and the alignment device 3 and joint portions of the contacts 2 and the conductors 50. Since the receiving cavity 12 is substantially plugged by the contacts 2 and the forward plate 31 with the bars 310 thereon, the housing 1 will not deformed/curved even though there is a relative heavy pressure applying to the housing 1 during over molding process of the protecting cover 6.

Referring to FIG. 1 and FIG. 2 again, the cable assembly 100 in accordance with the present invention is High-Definition Multimedia Interface (HDMI) type cable assembly. To comply with HDMI interface, the contacts 2 of the cable assembly 100 are arranged in two rows along opposite inner surfaces of the housing 1, and the contact row in top wall 12 of the housing 1 is composed of 9 contacts while the another contact row is composed of 10 contacts. Thus, the contacts 2 in the two rows are not arranged in alignment with each other in the vertical direction of the housing 1. Obviously, the alignment device 3 in the preferred embodiment of the present invention also can be applied to other types of cable connector assemblies.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly, comprising:

an insulative housing defining a mating interface, a connecting interface and a plurality of passages extending between the mating interface and the connecting interface;

an alignment device assembled to the housing and having a spacer sealing rear openings of the passages in the connecting interface of the housing, the spacer defining a plurality of through holes respectively in alignment with the passages;

a plurality of contacts extending from the connecting interface toward the mating interface, each contact comprising a mating portion received in a corresponding passage and a tail portion adjacent to the connecting interface passing through corresponding through holes and arranged by the alignment device; and a cable having a plurality of conductors electrically connected to the terminals;

wherein the alignment device comprises a plurality of channels in communication with corresponding through holes for receiving the conductors of the cable and a positioning flange for preventing the conductors from escaping from corresponding channels; wherein the alignment device comprises a plurality of cutouts respectively offset from and in communication with corresponding channels, and wherein the conductors of the cable are pressed into corresponding channels from the cutouts to locate above corresponding tail portions of the contacts; wherein the alignment device comprises a plurality of posts extending rearwardly from the spacer, and wherein the channels and the cutouts are defined between the adjacent posts; wherein each conductor of the cable has a diameter larger than the narrowest distance between the adjacent posts for preventing the conductor pressed into the channel from jumping out from the cutout; wherein each post has a reversed L-shaped cross section and comprises a lateral portion away from and parallel to the supporting plate and a vertical portion, and wherein the lateral portions of the posts together form the positioning flange locating above the channels of the alignment device.

2. The cable assembly as claimed in claim 1, wherein the alignment device comprises a supporting plate rearwardly extending from the spacer, and wherein the tail portions of the contacts and the conductors of the cable lay on the supporting plate.

3. The cable assembly as claimed in claim 1, wherein the vertical portion of each post is composed of a first section near the supporting plate and a second section connecting with the lateral portion, and the first section having a lateral dimension larger than that of the second section so as to limit movement of the conductor in the channel.

4. The cable assembly as claimed in claim 1, wherein the alignment device comprises a forward plate forwardly extending from the spacer into the housing.

5. The cable assembly as claimed in claim 4, wherein the forward plate has a plurality of bars thereon respectively in alignment with the corresponding passages of the housing so as to substantially filling rear portion of the housing.

6. The cable assembly as claimed in claim 1, further comprising shielding shell sheathing over the housing.

7. The cable assembly as claimed in claim 6, wherein the shielding shell comprises an engaging portion rearwardly extending to engage with the alignment device.

8. The cable assembly as claimed in claim 7, wherein the engaging portion of the shielding shell defines a pair of apertures, and wherein the alignment device comprises a pair of projections latching with the apertures of the shielding shell.

9. The cable assembly as claimed in claim 1, further comprising a protecting cover partially molded over the housing.

10. The cable assembly as claimed in claim 1, wherein the contacts are arranged in two rows along opposite inner surfaces of the housing.

11. The cable assembly as claimed in claim 1, wherein the two rows of contact are different in contact number.

12. Cable connector assembly comprising:

an insulative housing defining opposite mating interface and connecting interfaces;

a receiving cavity defined in the housing around the mating interface for receiving a complementary connector;

a plurality of passages extending between the mating interface and the connecting interface and in communication with said receiving cavity;

an alignment device assembled to the housing covering the connecting interface; and a plurality of contacts disposed in the corresponding passages, respectively, each of said contacts including a front mating portion extending toward the mating interface, a medial retaining portion, and a rear tail portion extending rearwardly out of the connecting interface;

the alignment device including a spacer and a support plate rearwardly extending from the spacer, the spacer defining therein a plurality of holes and channels extending in alignment with the corresponding passages, respectively, along a front-to-back direction for organizing corresponding wires which are connected to the corresponding tail portions, respectively; wherein each channel defines a curved vertical cross-sectional configuration so as to have the corresponding tail portion unexposed to an exterior in an upward direction due to a lateral extending portion of the support plate above each channel; wherein the alignment device comprises a plurality of posts extending rearwardly from the spacer, and wherein the channels and the cutouts are defined between the adjacent posts; wherein, each post has a reversed L-shaped cross section and comprises said lateral portion away from and parallel to the supporting plate and a vertical portion, and wherein the lateral portions of the posts together form the positioning flange locating above the channels of the alignment device.

* * * * *